United States Patent [19]

Cho et al.

[11] Patent Number: 4,984,322

[45] Date of Patent: Jan. 15, 1991

[54] ELASTOMERIC DISC FOR USE ON A PIPELINE PIG

[75] Inventors: Hyun J. Cho, Tulsa; William J. Rankin, Sapulpa, both of Okla.

[73] Assignee: TDW Delaware, Inc.

[21] Appl. No.: 433,535

[22] Filed: Nov. 7, 1989

[51] Int. Cl.[5] ..... B08B 9/04

[52] U.S. Cl. ..... 15/104.061; 15/104.062

[58] Field of Search ..... 15/104.061, 104.062, 15/3.5, 3.51

[56] References Cited

U.S. PATENT DOCUMENTS

| | | | |
|---|---|---|---|
| 1,966,819 | 7/1934 | Irvin | 15/104.061 |
| 2,283,460 | 5/1942 | Pumphrey | 15/104.061 |
| 2,332,984 | 10/1943 | Brackeen | 15/104.061 |
| 2,402,796 | 6/1946 | Wood | 15/104.061 |
| 2,544,290 | 3/1951 | Bailey | 15/104.061 |
| 2,601,614 | 6/1952 | Johnson | 15/104.061 |
| 3,740,790 | 6/1973 | Koppes | 15/104.061 |
| 3,766,587 | 10/1973 | French | 15/104.061 |
| 3,778,859 | 12/1973 | Donnelly | 15/104.061 |
| 3,906,576 | 9/1975 | Knapp et al. | 15/104.061 |
| 4,413,370 | 11/1983 | Payne et al. | 15/104.061 |
| 4,509,222 | 4/1985 | Knapp | 15/104.061 |

FOREIGN PATENT DOCUMENTS

| | | | |
|---|---|---|---|
| 673740 | 6/1952 | United Kingdom | 15/104.061 |

*Primary Examiner*—Edward L. Roberts
*Assistant Examiner*—Gary K. Graham
*Attorney, Agent, or Firm*—Head and Johnson

[57] ABSTRACT

An elastomeric disc for use on a pipeline pig of the type having a longitudinal body supported centrally within a pipeline for movement by fluid flow therethrough, the disc being in the form of a unitary elastomeric member having an outer peripheral surface concentric with the pipeline pig body longitudinal axis and having an inner portion of selected thickness with means for attachment to the pipeline pig body whereby the disc is supported in a plane perpendicular the pipeline line axis, the disc member having an integrally formed circumferential outer portion, the outer portion being of increased thickness in relation to the spacing thereof from the disc center, the outer peripheral surface being defined by first and second intersecting frustraconical surfaces, one of the surfaces being parallel to the inner wall of the pipeline through which the disc is moved in a first direction and the other of the surfaces being parallel to the inner wall of the pipeline when the disc is moved in a second direction.

1 Claim, 3 Drawing Sheets

ELASTOMERIC DISC FOR USE ON A PIPELINE PIG

SUMMARY OF THE INVENTION

Pipeline pigs are frequently employed in pipelines for a variety of services and are typically constructed to move by the force of fluid flow through a pipeline. The fluid may be in the form of water, petroleum products such as gasoline, diesel fuel, crude oil, propane, and so forth, or may be in the form of gas, such as natural gas. One of the primary reasons for sending a pig through a pipeline is to clean the interior of the pipeline of foreign matter, such as dirt, sand, rocks, welding wire ends, scale, water, liquids in a gas line, etc. A cleaning pig typically includes a body which is supported centrally within the pipeline, the body having an external diameter of significantly less than the internal diameter of the pipeline. To this pig body is supported discs or cups for contacting the wall of the pipeline. The cups or discs serve several purposes. First, they serve to support the pig body centrally within the pipeline. Second, at least one of the discs serves to seal the pipeline and to thereby cause the pig to be moved through the pipeline by the force of fluid flow therethrough. The third basic function of such discs is to contact the inner wall of the pipeline to scrape scale or other foreign matter thereto. In this manner the pig, as it is moved by fluid flow through the pipeline, dislodges and carries with it foreign matter.

For these basic purposes, it has been known in the pipeline pig art to provide pipeline pigs having elastomeric members, such as discs or cups, extending therefrom. For background reference to such pipeline pigs using elastomeric discs, reference may be had to the following U.S. Pat. Nos.: 2,283,460; 2,601,614; 3,740,790; 3,766,587; 3,906,576; 4,509,222; 4,413,370.

The elastomeric disc of the present disclosure provides improvements and overcomes disadvantages and limitations in the known type of elastomeric discs. The present disclosure is of an elastomeric disc for use on a pipeline pig in which the pig is the type having a longitudinal body supported centrally within a pipeline. The pig is moved by the force of fluid flow through the pipeline.

The disc is in the form of a unitary elastomeric member having a center and an outer peripheral surface which is concentric with the center. The disc has an inner portion of selected thickness, including means for attachment to a pipeline pig body whereby the disc is supported in a plane perpendicular to the longitudinal axis of the pig body and also perpendicular to the longitudinal axis of the pipeline through which the pigs passes by fluid flow.

The disc member has an integral formed circumferential outer portion having a peripheral surface thereon. The outer portion is of increased thickness in proportion to the spacing thereof from the disc center.

The outer peripheral surface of the disc is defined by a first and a second intersecting frustraconical surface. One of these surfaces is parallel to the inner wall of a pipeline through which the disc is passed in a first direction and the other of these surfaces is parallel to the inner wall of the pipeline when the disc is moved through the pipeline in a opposite direction.

In the preferred configuration of the elastomeric disc wherein the disc has opposed side surfaces, one side surface is substantially in a plane perpendicular to the pipeline axis as the disc is moved by fluid flow through the pipeline in one direction, and the other side surface is substantially perpendicular to the plane of the pipeline axis as the disc is moved by fluid flow through the pipeline in the opposite direction.

A better understanding of the invention will be had by reference to the following description and claims, taken in conjunction with the attached drawings.

DESCRIPTION OF THE PREFERRED EMBODIMENT

Figure 1:
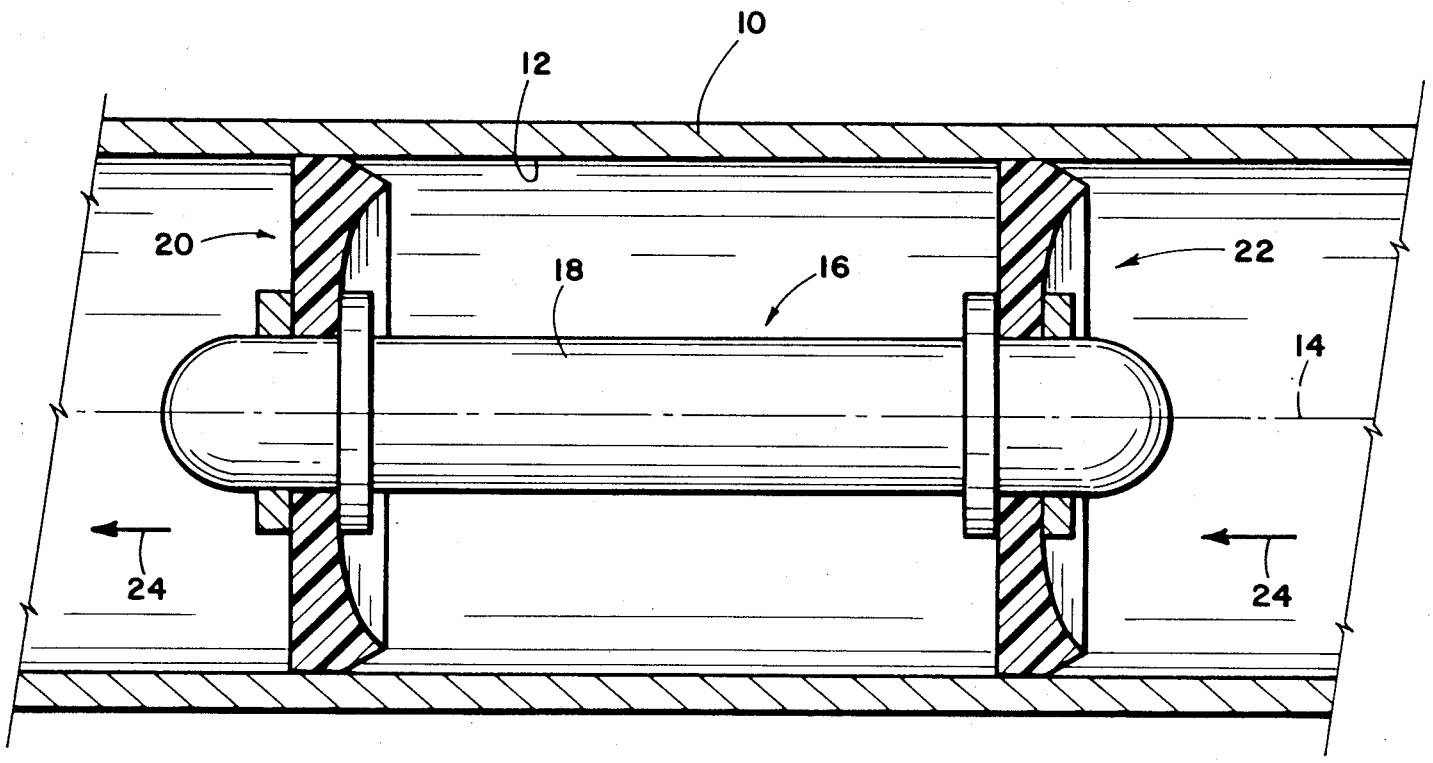
FIG. 1 is an elevational, cross-sectional view of a pipeline having a pig therein employing an elastomeric disc of the type of this disclosure, and showing the pig as it is moved by the force of fluid flow through the pipeline.

Referring to the drawings and first to FIG. 1, a pipeline is indicated generally by the numeral 10, having an internal circumferential surface 12 and an axis 14. Positioned within the pipeline is a pig generally indicated by the numeral 16, formed of a pig body 18 which is centrally supported within the pipeline, the external diameter of the pig body 18 being substantially less than that of the diameter of the internal circumferential surface 12. Pig body 18 has a longitudinal axis which is generally coincident with the pipeline axis 14.

Affixed to the pig body 18 is a first elastomeric disc member generally indicated by the numeral 20 and an identical, second elastomeric disc 22. The function of the discs 20 and 22 are first, to support the pig body 18 centrally within the pipeline 10; second, to seal the interior of the pipeline from fluid flow, which fluid flow occurs in the direction indicated by the arrows 24; and third, to scrape against the interior circumferential surface 12 of the pipeline to remove scale and contaminants. This removed scale and contaminants, as well as other foreign matter such as rocks, sand, dirt, welding wire ends, water, and so forth, is pushed in front of the pipeline pig as it moves through the interior of the pipeline so that such foreign material can be removed from the pipeline. This disclosure is concerned only with the configuration of the elastomeric discs 20 and 22, and reference may be had to FIGS. 3–6, which exemplifies the preferred embodiment of the invention.

Figure 2:
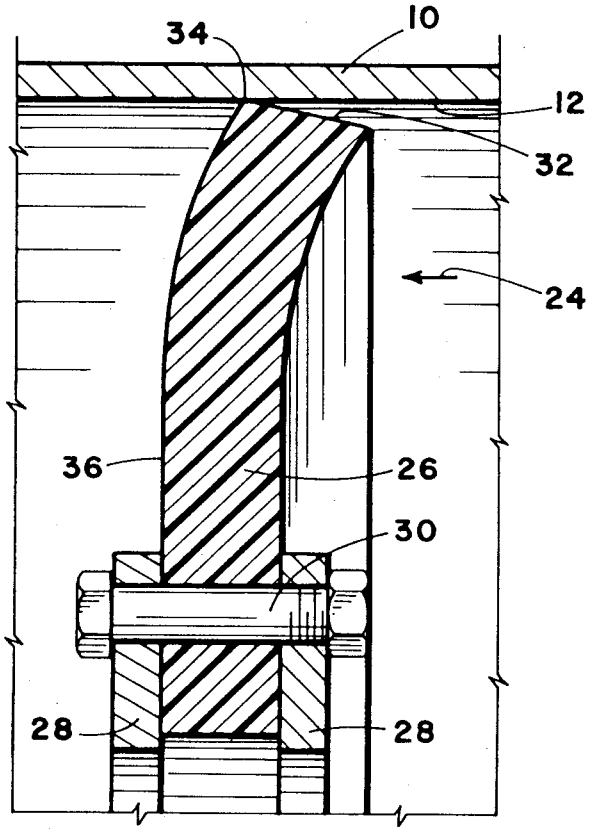
Fig. 2 (PRIOR ART)
FIG. 2 is an enlarged cross-sectional view of the typical prior art in which the disc, that is, of a flat, uniform thickness and showing the disc as it is deflected as the pig to which it is attached (not shown) is moved by fluid flow through the pipeline.
Figure 5:
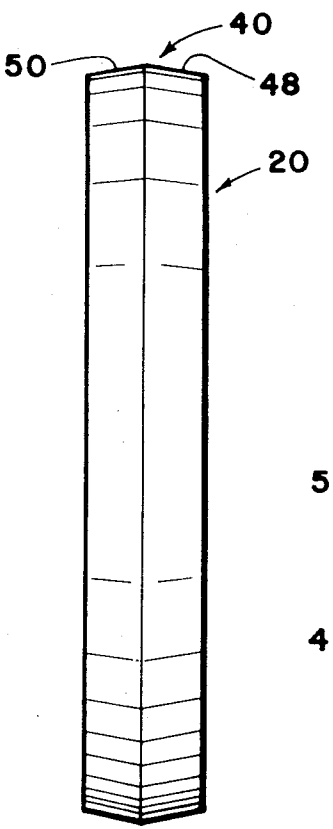
FIG. 5 is an end view of the disc of FIG. 4.
Figure 4:
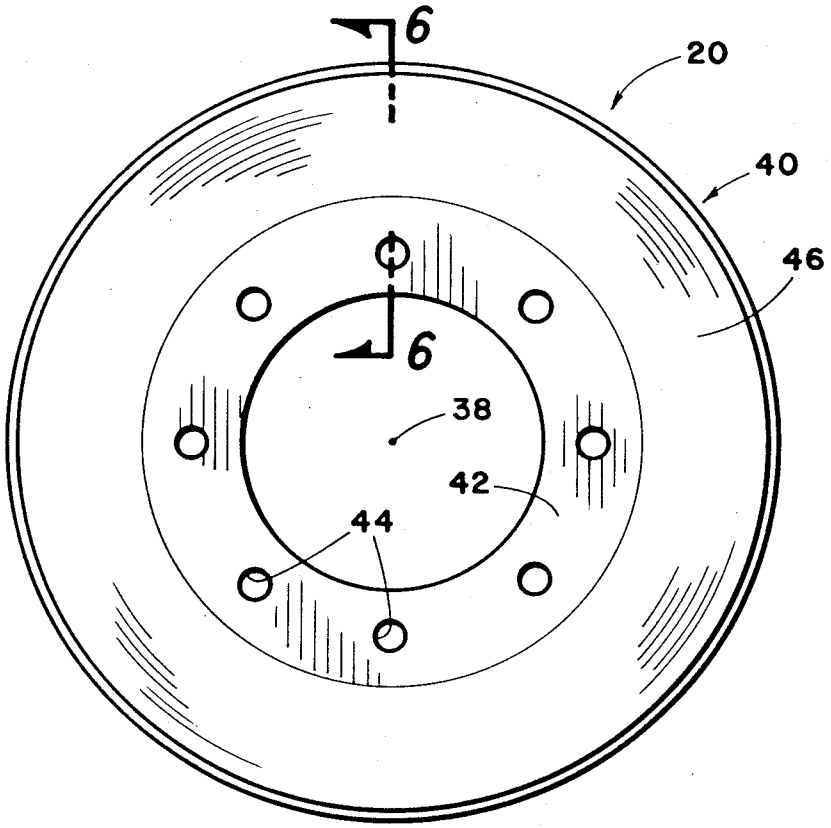
FIG. 4 is an elevational side view of an elastomeric disc which employs the principles of this disclosure.

FIG. 2 is an enlarged partial cross-sectional view of a type of disc which best represents the state of the art, that is, the type of disc most frequently employed at the present time. This disc is of the flat type, that is, it is formed of a flat disc 26 of elastomeric material and of generally uniformed thickness. The disc 26 is held to a pipeline pig body, such as by flanges 28 and bolts 30 (only one of which is shown). The disc 26 has an outer peripheral surface 32. Due to the deflection of the disc as it is moved through pipeline 10 by the force of fluid flow, only a leading circumferential edge 34 contacts the inner pipeline wall 12. Due to the small circumferential contact area this edge soon wears away. The forward surface 36 of disc 26 is curved rearwardly with respect to the direction of movement of the disc so that a wedge-shaped effect at the periphery 34 is formed, tending to force foreign matter under the peripheral edge of the disc. The present disclosure is directed towards an improvement in the prior art, as reflected by FIG. 2. For this purpose a disc, as shown in FIGS. 4–6, is the preferred embodiment.

The disc 20 of this disclosure is a unitary member formed of elastomeric material, such as natural or synthetic rubber, plastic or the like. Polyurethane is an ideal material for many applications.

Figure 6:
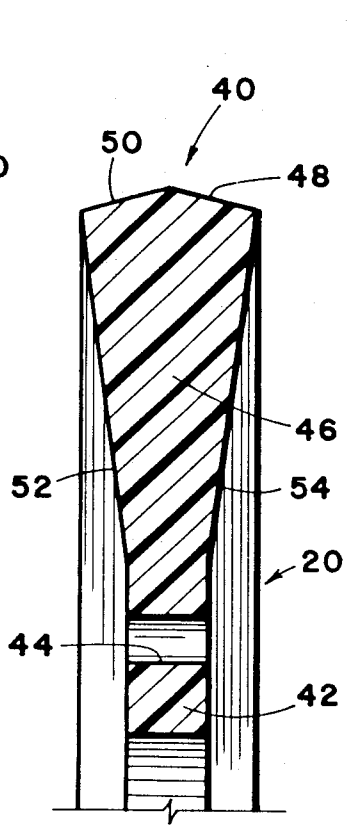
FIG. 6 is a fragmentary cross-sectional view, enlarged, taken along the line 6—6 of FIG. 4, showing the disc as it exists when not in use on a pig within a pipeline.

The disc has a center 38, an outer peripheral surface generally indicated by the numeral 40 which is concentric about the disc center 38, an inner portion 42 which is of selected thickness and generally uniform thickness, as illustrated in FIG. 6. The inner portion 42 may be provided with openings 44, as illustrated, as a means of attachment of the disc to a pipeline pig body. As attached to a pipe body, the inner portion 42 extends generally in a plane perpendicular to the longitudinal axis 14 of the pig and also generally perpendicular to the longitudinal axis of the pipeline in which the pig having the disc 20 thereon is positioned.

The disc further includes an integrally formed circumferential outer portion 46 which is of increased thickness in proportion to the spacing away from the disc center 38. That is, the thickness of the outer portion 46 increases in the direction towards the peripheral surface 40.

The outer peripheral surface 40 is defined by a first frustraconical surface 48 and a second frustraconical surface 50. The surfaces 48 and 50 intersect each other.

The disc 20 includes a first side surface 52 and a second side surface 54.

Figure 3:
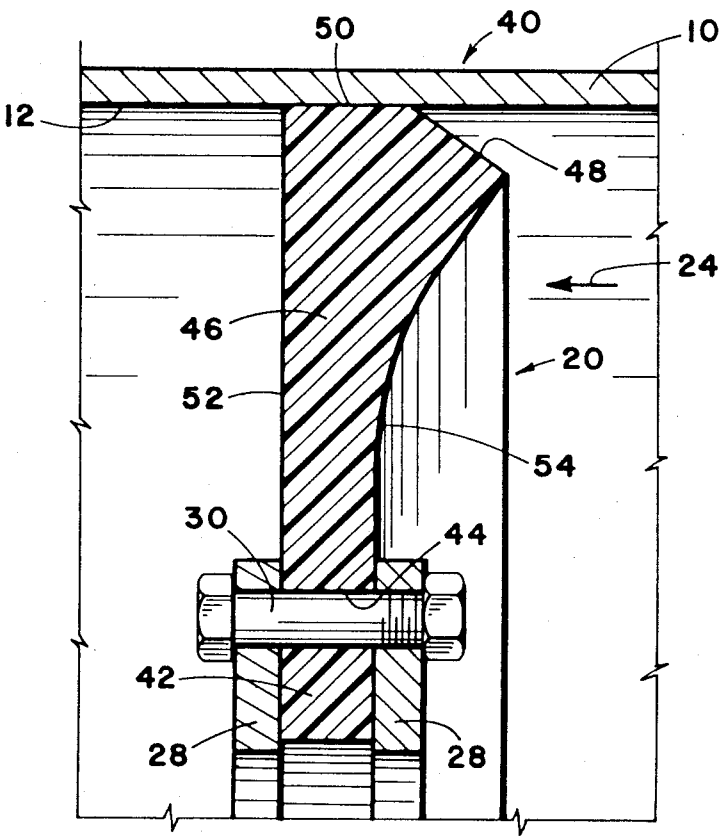
FIG. 3 is an enlarged partial cross-sectional view of the disc of this disclosure as it is moved by the force of fluid flow through the pipeline.

FIG. 3 shows the disc 20 in use within a pipeline 10, the disc being mounted on a pipeline pig body, which is not shown, however, flanges 28 and a bolt 30 as representative of means of mounting the disc on a pig body are illustrated. In FIG. 3, the pipeline pig having disc 20 thereon is moved through the pipeline by fluid flow in the direction indicated by arrow 24. The second frustraconical surface 50 is parallel to the inner wall 12 and the first side surface 52 is generally in a plane perpendicular the pipeline axis. This configuration provides, as the disc 20 is in use, the arrangement wherein the surface 50 becomes a cylindrical surface of external diameter conforming to the diameter of the internal circumferential pipeline surface 12. The arrangement of the disc provides a superior cleaning action in that, unlike the prior art of FIG. 2, rather than a short length circumferential surface engaging the internal pipe wall, substantially the full frustraconical surface 50 of the disc engages the internal pipe wall. In addition, since the first side surface 52 is generally planar with respect to the pipeline axis, a wedge-shaped action which would tend to force foreign matter under the cup edge is not created, as is the case with respect to the prior art illustrated in FIG. 2.

The pig can be orientated in the opposite direction in which the first frustraconical surface 48 would engage and become parallel to the internal pipeline wall 12, thus permitting the disc to function bi-directionally. This bi-directional advantage is made use of by running the pig in one direction through a pipeline, removing it, and then reversing the orientation and running the pig through the same or different pipeline in the opposite direction so that thereby the full economic life of the disc is achieved.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An elastomeric disc for use on a pipeline pig of the type having a longitudinal body supported centrally within a pipeline for movement by fluid flow therethrough, the disc comprising:

a unitary elastomeric member having an inner portion of selected thickness and having a center;

an outer peripheral surface normally concentric with said center;

means for attachment of said inner portion to a pipeline pig body whereby the disc is supportable in a plane perpendicular the pipeline axis;

an integrally formed circumferential outer portion integrally extending from said inner portion to said outer peripheral surface and having said peripheral surface thereon, the outer portion having opposed side surfaces, the outer portion being of increased thickness in relation to the spacing thereof from the disc center, the outer peripheral surface being defined by first and second intersecting frustraconical surfaces such that one of said frustraconical surfaces is parallel to the inner wall of a pipeline through which the disc is moved in a first direction and the other of said frustraconical surfaces is parallel to the inner wall of a pipeline when the disc is moved in a second direction, the first frustraconical surface being substantially perpendicular to said first side surface when the disc is moved in one direction within a pipeline and the second frustraconical surface being substantially perpendicular to said second side surface when the disc is moved in the opposite direction within a pipeline, the disc outer portion thereby providing support to said frustraconical surfaces, the intersection of said side surfaces with said frustraconical surfaces providing opposed wiping leading edges depending upon the direction of the travel of the disc in a pipeline.

* * * * *